US007792473B2

(12) United States Patent
Sakai

(10) Patent No.: US 7,792,473 B2
(45) Date of Patent: Sep. 7, 2010

(54) DEVELOPMENT APPARATUS AND IMAGE FORMING APPARATUS

(75) Inventor: Masahiro Sakai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 272 days.

(21) Appl. No.: 12/036,444

(22) Filed: Feb. 25, 2008

(65) Prior Publication Data

US 2008/0205941 A1 Aug. 28, 2008

(30) Foreign Application Priority Data

Feb. 27, 2007 (JP) ..... 2007-047567

(51) Int. Cl.
*G03G 15/09* (2006.01)

(52) U.S. Cl. ..... 399/273; 399/277

(58) Field of Classification Search ..... 399/267, 399/273, 277; 347/140
See application file for complete search history.

(56) References Cited

U.S. PATENT DOCUMENTS 3,703,395 A * 11/1972 Drexler et al. ..... 399/277 X
4,391,503 A * 7/1983 Pugh ..... 399/273 X
4,601,258 A * 7/1986 Kondoh ..... 399/273 X
5,666,620 A * 9/1997 Kobayashi ..... 399/273
6,047,154 A * 4/2000 Kawaguchi ..... 399/277 X

FOREIGN PATENT DOCUMENTS

| | | |
|---|---|---|
| JP | 07-098545 | 4/1995 |
| JP | 09-034263 | 2/1997 |
| JP | 9-258559 | 10/1997 |
| JP | 11-095557 | 4/1999 |
| JP | 11-237788 A | 8/1999 |

* cited by examiner

*Primary Examiner*—Sandra L Brase
(74) *Attorney, Agent, or Firm*—Nixon & Vanderhye, PC

(57) ABSTRACT

A development apparatus that performs development by forming a magnetic brush using a two-component developer is provided with a developer tank that stores developer; a developer bearing member provided with a development sleeve that carries the developer stored in the developer tank on the outer circumferential face and transports the developer to a development area where the electrostatic latent image on the image bearing carrier is developed, the development sleeve being provided with at least a main pole magnet in which a main pole is formed that faces the development area, and an interpole magnet in which an interpole is formed adjacent to the main pole on the downstream side in a developer transport direction; and a carrier recovery means in which a pushing/bending magnetic pole of the same polarity as the interpole is formed such that magnetic force lines of the interpole in the developer bearing member are pushed/bent to the inside of the developer tank.

8 Claims, 6 Drawing Sheets

DEVELOPMENT APPARATUS AND IMAGE FORMING APPARATUS

BACKGROUND OF THE TECHNOLOGY

This application claims priority under 35 U.S.C. §119(a) on Japanese Patent Application No. 2007-047567 filed in Japan on Feb. 27, 2007, the entire contents of which are herein incorporated by reference.

The present technology relates to a development apparatus that is applicable in an electrophotographic image forming apparatus such as a copier, printer, digital multifunction device, or the like, and to an image forming apparatus, and more specifically relates to a development apparatus and image forming apparatus in which an electrostatic latent image formed on an image bearing carrier is developed and made visible using a two-component developer having a toner and a carrier as main components.

In an electrophotographic image forming apparatus, the surface of an image bearing carrier (for example, a photosensitive body) is charged, an image is exposed in that charging area to form an electrostatic latent image, and the electrostatic latent image is developed and made visible with a development apparatus.

In a development apparatus that performs development using a two-component developer that includes a toner and a carrier, ordinarily a system is adopted in which a magnetic brush is formed in a developer bearing member, and only toner is affixed to the image bearing carrier. The development apparatus that performs development using a two-component developer, ordinarily, is provided with a developer tank in which the developer is stored, and a developer bearing member (for example, a developer roller) that bears the developer on the outer circumferential face and transports the developer to a developer area where the electrostatic latent image on the image bearing carrier is developed. In the developer bearing member, a plurality of magnets are disposed within a sleeve.

In this development apparatus, the carrier that has attracted the toner with a frictional charge is attracted in a brush-like shape to the outer circumferential face of the sleeve by the magnets inside the sleeve, thus forming a magnetic brush. The carrier attracted to the outer circumferential face of the sleeve is transported along with toner to the development area by rotating the sleeve relative to the magnets within the sleeve. A portion of toner that has been transported to the development area moves to the electrostatic latent image on the image bearing carrier due to a difference in electric potential between a development bias voltage applied to the sleeve and the electrostatic latent image, and thus the electrostatic latent image is developed to form a toner image. On the other hand, the carrier, in a state attracted to the outer circumferential face of the sleeve by the magnetic force of magnets inside the sleeve, is returned inside the developer tank along with toner that was not contributed to development.

Afterward, in the image forming apparatus, the toner image that has been formed on the image bearing carrier by development of the development apparatus is transferred to an intermediate transfer member such as an intermediate transfer belt or to a recording material such as recording paper. When the toner image has been transferred to an intermediate transfer member, the toner image is further transferred to a recording material, and then fixed to the recording material by a fixing apparatus.

In this sort of image forming apparatus, during development, carrier may scatter from the magnetic brush in the developer bearing member and become affixed to the image bearing carrier. Carrier that is affixed to the image bearing carrier will reduce adhesion of the intermediate transfer member or the recording material to the image bearing carrier during transfer, causing white or omitted characters when performing transfer to the intermediate transfer member or the recording material. Also, carrier may scatter from the magnetic brush in the developer bearing member and fall to the inside of the image forming apparatus. This will cause a malfunction or the like of the image forming apparatus.

In particular, the diameter of the carrier used in the developer has become smaller as image quality of image forming apparatuses has increased in recent years, and the developer transport speed (for example, rotational speed of a developer roller) of the sleeve in the developer bearing member has increased as the speed of image forming processing has increased. As a result, there is a tendency for the affixing force of the sleeve and the carrier to weaken, and thus the above problems have become pronounced.

Therefore, in development apparatuses often a carrier recovery member is provided near the downstream side in the developer transport direction of the developer bearing member from the development area.

In a development apparatus provided with this carrier recovery member, ordinarily, a plurality of magnets are provided inside a carrier recovery roller. The carrier recovery roller is rotated relative to the inside magnets when development is performed. Carrier that affixes to the image bearing carrier during development is attracted to the outer circumferential face of the carrier recovery roller by the magnetic force of the magnets inside the rotated carrier recovery roller. Carrier that has been attracted to the outer circumferential face of the carrier recovery roller is scraped from the outer circumferential face by a scraper disposed in contact with the outer circumferential face, recovered within the developer tank, and reused.

In this development apparatus, a configuration is adopted in which, among the magnetic poles within the carrier recovery roller, a magnetic pole for attracting the carrier from the image bearing carrier is positioned so as to face the surface of the image bearing carrier (see JP H9-34263A, lines 7-9 of paragraph [0010] and FIG. 3, and JP H7-98545A, lines 5-6 of paragraph [0027] and FIG. 2).

More specifically, in such a conventional development apparatus, it is assumed that carrier that, during development, scattered in the magnetic brush in the developer bearing member, moved to the image bearing carrier, and then affixed on the image bearing carrier is recovered. Because a magnetic pole for attracting carrier is positioned so as to face the surface of the image bearing carrier, there is no consideration of carrier that scatters in the magnetic brush, or example, carrier that scatters in the magnetic brush and is at a stage of moving to the image bearing carrier, or carrier that scatters in the magnetic brush and attempts to drop inside the image forming apparatus.

Also, in the conventional development apparatus, a plurality of magnetic poles are provided within the carrier recovery roller, including a magnetic pole for attracting carrier, so the surface area of each magnetic pole face is reduced. Such a configuration has the disadvantage that the strength of the magnetic poles is not large, so in reality it is not possible to effectively recover carrier when performing development, and this leads to a deterioration in print quality.

The present technology was made in view of the above problems, and it is an object thereof to provide a developer apparatus and image forming apparatus in which a carrier that is scattered in a magnetic brush in a developer bearing member during development can be recovered into a developer tank, and thus it is possible to eliminate problems due to carrier scattering such as a deterioration in image quality.

SUMMARY OF THE TECHNOLOGY

In order to address the above problems, the present technology provides a development apparatus that, in an image forming apparatus, develops an electrostatic latent image formed on an image bearing carrier by forming a magnetic brush using a two-component developer that includes a toner and a carrier, the development apparatus being provided with a developer tank that stores the developer; a developer bearing member provided with a development sleeve that carries the developer stored in the developer tank on the outer circumferential face and transports the developer to a development area where the electrostatic latent image on the image bearing carrier is developed, the development sleeve being provided with at least a main pole magnet in which a main pole is formed that faces the development area, and an interpole magnet in which an interpole is formed adjacent to the main pole on the downstream side in a developer transport direction; and a carrier recovery means in which a pushing/bending magnetic pole of the same polarity as the interpole is formed such that magnetic force lines of the interpole in the developer bearing member are pushed/bent to the inside of the developer tank. The present technology also provides an image forming apparatus provided with a development apparatus.

As described above, it is possible to provide a development apparatus and image forming apparatus in which it is possible to recover carrier that scatters in a magnetic brush in a developer bearing member during development into a developer tank, and thus it is possible to eliminate problems due to carrier scattering such as a deterioration in image quality. Specifically, according to the development apparatus and image forming apparatus of the present technology, the carrier recovery means is provided in which the interpole and the pushing/bending magnetic pole of the same polarity are formed such that the magnetic force lines of the interpole of the interpole magnet in the developer bearing member are pushed/bent to the inside of the developer tank, so it is possible to attract carrier that scatters in the magnetic brush in the developer bearing member during development to the developer tank side. Accordingly, it is possible to effectively recover carrier that scatters in the magnetic brush into the developer tank. Thus, it is possible to eliminate problems due to carrier scattering such as a deterioration in image quality.

It is possible to give the following as an example aspect in which in the carrier recovery means, the pushing/bending magnetic pole is formed so as to push/bend the magnetic force lines of the interpole to the inside of the developer tank.

Specifically, in this aspect, the carrier recovery means is provided with a pushing/bending magnet disposed near the downstream side in the developer transport direction of the developer bearing member from the development area, and in the pushing/bending magnet, one magnetic pole serves as the pushing/bending magnetic pole and is disposed at a position nearer to the interpole than the other magnetic pole, and taking as a reference a state in which a first imaginary line that joins both of the magnetic poles and a second imaginary line that joins both magnetic poles of the interpole magnet are orthogonal, the pushing/bending magnet is disposed such that the first imaginary line tilts in a direction that the one magnetic pole that serves as the pushing/bending magnetic pole approaches the interpole side.

In this aspect, it is preferable that, taking as a reference a state in which the first imaginary line and the second imaginary line are orthogonal, the pushing/bending magnet is disposed such that the first imaginary line tilts at an angle of 35 to 45° in the direction that the one magnetic pole that serves as the pushing/bending magnetic pole approaches the interpole side. By adopting such a configuration, it is possible to effectively attract carrier that scatters in the magnetic brush in the developer bearing member during development to the developer tank side. Thus, it is possible to more effectively recover carrier that scatters in the magnetic brush into the developer tank.

When the carrier recovery means is provided with the pushing/bending magnet in this manner, in an example aspect, the carrier recovery means is further provided with a cylindrical carrier recovery sleeve, inside of which is provided the pushing/bending magnet, and that is capable of rotating relative to the pushing/bending magnet, and a scraper that scrapes away carrier attracted to the outer circumferential face of the carrier recovery sleeve, and is disposed in contact with the outer circumferential face of the carrier recovery sleeve so as to guide that carrier into the developer tank. By adopting such a configuration, even if there is carrier in the magnetic brush in the developer bearing member that cannot be recovered into the developer tank by the pushing/bending magnet, it is possible to attract the carrier to the outer circumferential face of the carrier recovery sleeve. Also, by rotating the carrier recovery sleeve, carrier attracted to the outer circumferential face of the rotated carrier recovery sleeve can be scraped away by the scraper and guided into the developer tank.

In the development apparatus and the image forming apparatus according to the present technology, it is preferable that the pushing/bending magnet is a single magnet. By adopting such a configuration in which the pushing/bending magnet is a single magnet, it is possible to increase the area of the face of the one magnetic pole serving as the pushing/bending magnetic pole, and to that extent it is possible to increase the strength of the magnetic pole.

When the carrier recovery means is provided with the carrier recovery sleeve and the scraper, and the pushing/bending magnet provided in the carrier recovery sleeve is a single magnet, it is preferable that in a state in which the first imaginary line and the second imaginary line are orthogonal, the pushing/bending magnet is disposed at a position such that the first imaginary line is offset to the interpole side from the center of rotation of the carrier recovery sleeve, and from this state so as to be tilted around the center of rotation. By adopting such a configuration, it is possible to place the pushing/bending magnet as close as possible to the interpole.

Also, when the carrier recovery means is provided with the carrier recovery sleeve and the scraper, the scraper is preferably formed from a resin film. By adopting such a configuration, it is possible to suppress damage to the outer circumferential face of the carrier recovery sleeve, and thus it is possible to achieve greater longevity of the carrier recovery sleeve. In this case, by way of example, the pressure with which the scraper contacts the outer circumferential face of the carrier recovery sleeve is about 1.96 to 6.86 kPa (20 to 70 g/cm$^2$), but the pressure is not limited thereto. That is, in an example aspect, the scraper contacts the outer circumferential face of the carrier recovery sleeve with a pressure of 1.96 to 6.86 kPa. By adopting such a configuration, carrier on the outer circumferential face of the carrier recovery sleeve can be reliably recovered into the developer tank by the scraper.

DESCRIPTION OF THE PREFERRED EMBODIMENTS

Hereinafter, an embodiment of the present technology will be described in detail with reference to the attached drawings.

Figure 1:
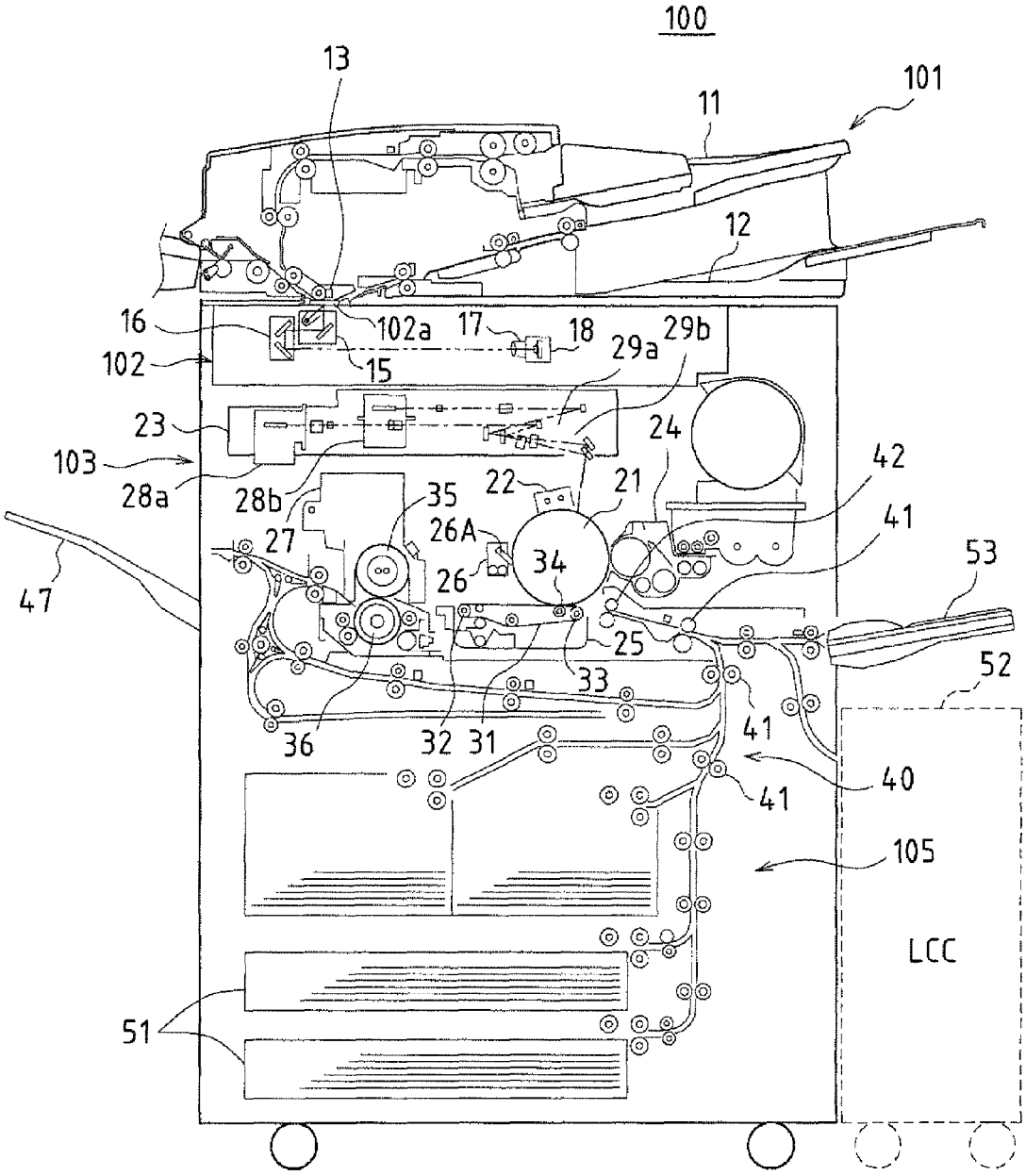
FIG. 1 is a schematic side view that shows an image forming apparatus provided with an embodiment of a development apparatus.

FIG. 1 is a schematic side view that shows an image forming apparatus 100 provided with an embodiment of a development apparatus 24.

First, the overall configuration of the image forming apparatus 100 shown in FIG. 1 will be described. Here, the image forming apparatus 100 shown in FIG. 1 is a digital multifunction device that forms an image according to an electrophotographic image forming process. The image forming apparatus 100 is provided with an image bearing carrier (here a photosensitive drum) 21, a charging apparatus (here a charging unit) 22 for charging the surface of the photosensitive drum 21, an exposure apparatus (here an exposure unit) 23 for forming an electrostatic latent image on the photosensitive drum 21, a development apparatus 24 for developing the electrostatic latent image with developer to form a toner image on the photosensitive drum 21, a transfer apparatus (here a transfer unit) 25 for transferring the toner image on the photosensitive drum 21 to a recording material such as recording paper, a fixing apparatus (here a fixing unit) 27 for fixing the transferred image on the recording material to the recording material, and a cleaning apparatus (here a cleaning unit) 26 for removing residual toner that remains on the surface of the photosensitive drum 21 without being transferred by the transfer unit 25.

In detail, the image forming apparatus 100 acquires image data that has been captured from an original, or acquires image data received from an external image data output apparatus such as a facsimile apparatus or terminal apparatus, and forms a monochrome image expressed by this image data on a recording material. The image forming apparatus 100 is configured from, broadly speaking, an original transport portion (ADF), an image capturing portion 102, an image forming portion 103, a transport path 40 and a paper feed portion 105.

When an original of at least one page is placed in an original placement tray 11, the original transport portion 101 transports the original by drawing out the original from the original placement tray 11 page by page. Also, the original transport portion 101 guides the original to, and causes the original to pass by, an original capturing window 102*a* of the image capturing portion 102, and discharges this original to an original discharge tray 12.

Above the original capturing window 102*a*, a CIS (Contact Image Sensor) 13 is disposed. The CIS 13, when the original passes by the original capturing window 102*a*, repeatedly captures an image of the back face of the original in a main scanning direction, and outputs image data that expresses the image of the back face of the original.

The original capturing portion 102, when the original passes by the original capturing window 102*a*, exposes the front face of the original to light with a lamp of a first scanning unit 15. Also, the original capturing portion 102 guides reflected light from the front face of the original to an imaging lens 17 with mirrors of the first scanning unit 15 and a second scanning unit 16, and forms an image of the front face of the original on a CCD (Charge Coupled Device) 18 with the imaging lens 17. The CCD 18 repeatedly captures an image of the front face of the original in the main scanning direction, and outputs image data that expresses the image of the front face of the original.

The image capturing portion 102, further, when the original has been placed on a glass platen in the upper face of the image capturing portion 102, moves the first and second scanning units 15 and 16 while maintaining a predetermined speed relationship relative to each other, and exposes the front face of the original on the glass platen to light with the first scanning unit 15. Also, the image capturing portion 102 guides reflected light from the front face of the original to the imaging lens 17 with the first and second scanning units 15 and 16, and forms an image of the front face of the original on a CCD (Charge Coupled Device) 18 with the imaging lens 17.

A control portion (not shown) that includes a microcomputer or the like performs various image processing on the image data that has been output from the CIS 13 or the CCD 18, and then that image data is output to the image forming portion 103.

The image forming portion 103 records an original image to recording material based on image data, and is provided with the previously described photosensitive drum 21, charging unit 22, exposure unit 23, development apparatus 24, transfer unit 25, cleaning unit 26, and fixing unit 27.

The photosensitive drum 21, here, is an organic photosensitive body whose surface layer is made from an organic photoconductive material. The charging unit 22, here, is a charger-type charging unit. Note that the charging unit 22 may also be roller-type or brush-type charging unit that contacts the photosensitive drum 21.

The exposure unit 23, here, is a laser scanning unit (LSU) provided with two laser irradiating portions 28*a* and 28*b* and two mirror groups 29*a* and 29*b*. Image data is input to the exposure unit 23, and the exposure unit 23 emits a laser beam corresponding to the image data respectively from the laser irradiating portions 28*a* and 28*b*. Also, the exposure unit 23 irradiates these laser beams to the photosensitive drum 21 via the mirror groups 29*a* and 29*b*, and thus exposes the uniformly charged surface of the photosensitive drum 21 to light. Thus, it is possible to form an electrostatic latent image on the surface of the photosensitive drum 21. Also, in the exposure unit 23, here, a two-beam system provided with the two laser irradiating portions 28*a* and 28*b* is adopted in order to be compatible with high speed image forming processing, thus lightening the burden that accompanies acceleration of irradiation timing.

Note that as the exposure unit 23, instead of a laser scanning unit, it is also possible to use an EL write head or LED write head in which light-emitting elements are lined up in an array.

The development apparatus 24 develops an electrostatic latent image formed on the photosensitive drum 21 by forming a magnetic brush using a two-component developer (not shown) in which toner and a magnetic carrier are main components, and thus forms a toner image (also referred to as a visible image) on the surface of the photosensitive drum 21. The development apparatus 24 will be described in detail below.

The transfer unit 25, here, is provided with a transfer belt 31, a drive roller 32, an idler roller 33, and an elastic conductive roller 34. The transfer belt 31 is stretched across these rollers 32 to 34 and other rollers. The transfer belt 31, by the surface of the transfer belt 31 moving due to rotation of these rollers, transports a recording material that has been placed on the surface of the transfer belt 31. The transfer belt 31 has a predetermined resistance value (for example, $1\times10^{9}$ to $1\times10^{13}\Omega$/cm). The elastic conductive roller 34 is pressed against the surface of the photosensitive drum 21 via the transfer belt 31. Thus, it is possible to press a recording material on the transfer belt 31 against the surface of the photosensitive drum 21. A transfer electric field with a polarity opposite to that of the charge of the toner image on the surface of the photosensitive drum 21 is applied to the elastic conductive roller 34. With this opposite polarity transfer electric field, the toner image on the surface of the photosensitive drum 21 can be transferred to the recording material on the surface of the transfer belt 31. For example, when the toner image has a charge with (−) polarity, a transfer electric field with (+) polarity is applied to the elastic conductive roller 34.

The fixing unit 27, here, applies heat and pressure to the recording material, and thus thermally fixes the toner image on the recording material.

In detail, the fixing unit 27 is provided with a hot roller 35 and a pressure roller 36. Inside the hot roller 35, a heat source is provided in order to set the surface of the hot roller 35 to a predetermined temperature (fixing temperature: about 160 to 200° C.). Also, an unshown pressure member is disposed at both ends of the pressure roller 36, such that the pressure roller 36 makes contact with the hot roller 35 with a predetermined pressure. When the recording material is transported to a contact portion (referred to as a fixing nip portion) between the hot roller 35 and the pressure roller 36, in the fixing unit 27, while the recording material is being transported by the rollers 35 and 36, the unfixed toner image on the recording material is hot-melted and pressure is applied. Thus, the toner image can be fixed on the recording material.

The cleaning unit 26, here, is configured to have a cleaning blade 26A that removes and recovers toner remaining on the surface of the photosensitive drum 21 after development and transfer.

A plurality of pairs of transport rollers 41 for transporting recording material and a pair of registrations rollers 42 are provided in the transport path 40. The pair of registration rollers 42 transport recording material from the plurality of pairs of transport rollers 41, synchronized with the electrostatic latent image on the photosensitive drum 21.

The paper feed portion 105 is provided with a plurality of paper feed trays 51. Each paper feed tray 51 is for accumulating a plurality of sheets of recording material, and here, the paper feed trays 51 are provided in the bottom portion of the image forming apparatus 100.

Also, in the side face of the image forming apparatus 100, a large capacity paper feed tray (LCC) 52 capable of storing a large amount of a plurality of types of recording material, and a manual feed tray 53 for supplying mainly recording material of a non-standard size and/or a small amount of recording material, are provided. A discharge tray 47 is disposed in the side face opposite to that of the manual feed tray 53.

Figure 2:
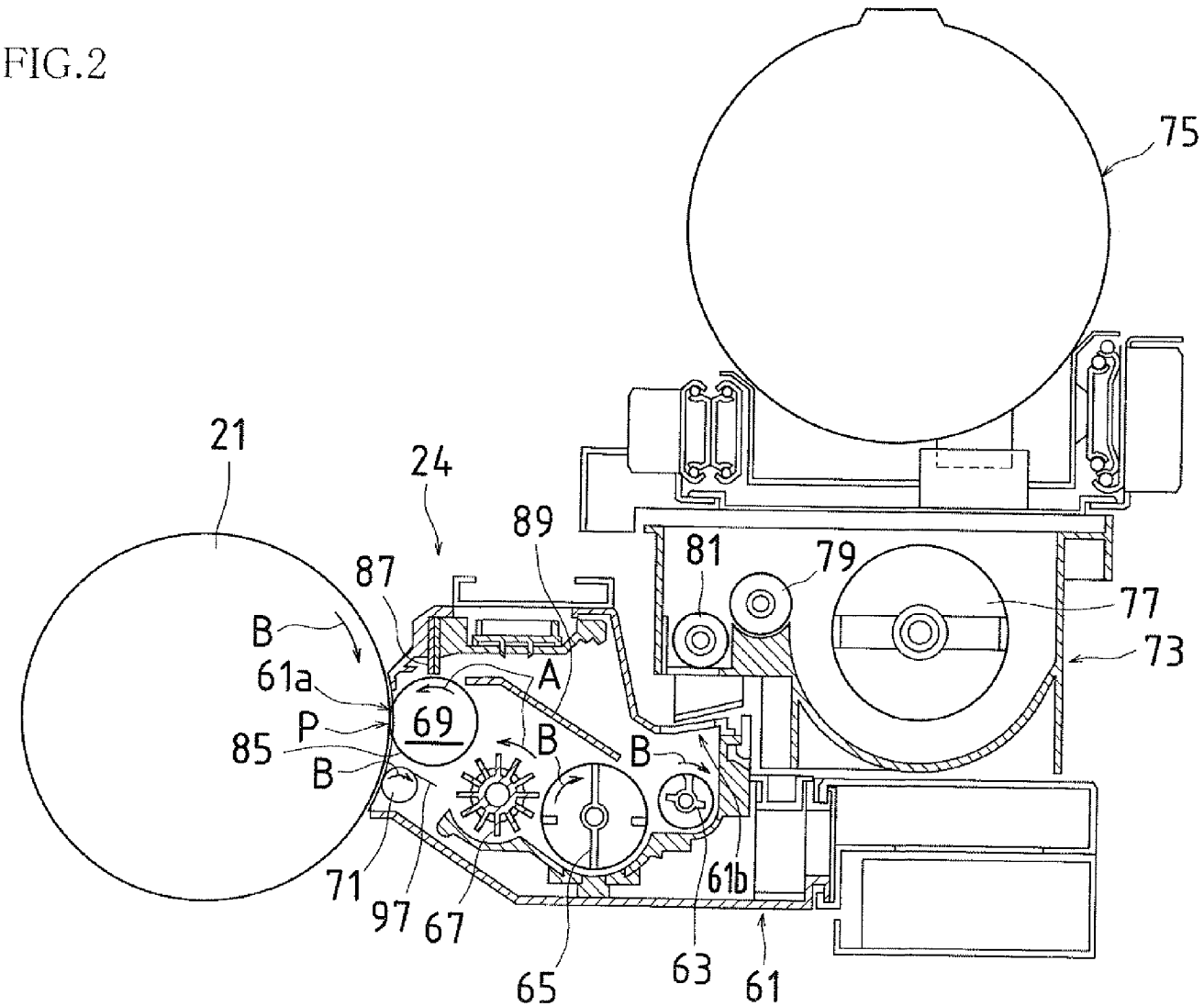
FIG. 2 is a schematic cross-sectional view of the development apparatus shown in FIG. 1.

Next is a detailed description of the development apparatus 24. FIG. 2 is a schematic cross-sectional view of the development apparatus 24 shown in FIG. 1.

As shown in FIG. 2, the development apparatus 24 is provided with a developer tank 61 and a developer bearing member 69. The developer tank 61 stores developer. The developer bearing member 69 is provided in the developer tank 61.

In detail, the developer tank 61 has a development opening portion 61*a* that is a hollow development case, in which a part of a development sleeve 85, described below, of the developer bearing member 69 is exposed. Also, in the developer tank 61, in addition to the developer bearing member 69, various rollers 63, 65, and 67 that transport and churn developer are provided.

In the development apparatus 24, toner is resupplied from a toner bottle 75. Here, a middle hopper 73 is linked to the development apparatus 24, and the toner bottle 75 is linked to the middle hopper 73. The toner bottle 75 supplies stored toner to the middle hopper 73.

Also, in the middle hopper 73, toner that has been supplied from the toner bottle 75 is temporarily accumulated, and the accumulated toner is resupplied to the development apparatus 24 as necessary by a plurality of rollers 77, 79, and 81. For example, by controlling operation of the plurality of rollers 77, 79, and 81 based on a detection value of an unshown toner concentration sensor provided in the developer tank 61, the toner accumulated in the middle hopper 73 is resupplied to the developer tank 61 via the plurality of rollers 77, 79, and 81.

In the developer tank 61, a resupply opening portion 61*b* that receives toner resupplied from the middle hopper 73 is provided at the top of an end portion on the opposite side as the development opening portion 61*a*. A transport roller 63 is provided below the resupply opening portion 61*b*, and a churning roller 65 is provided on the side of the transport roller 63 that is towards the developer bearing member 69. Also, a paddle roller 67 is provided on the side of the churning roller 65 that is towards the developer bearing member 69. That is, from a position below the resupply opening portion 61*b* towards the developer bearing member 69, the transport roller 63, the churning roller 65, and the paddle roller 67 are provided lined up in this order.

Also note that here, the churning roller 65 is disposed at a position displaced slightly below the other rollers 63 and 67. Further, the development sleeve 85 of the developer bearing member 69 is rotated in a predetermined first rotation direction (counter clockwise direction indicated by arrow A in FIG. 2). The paddle roller 67, here, is rotated in the first rotation direction A, and the transport roller 63 and the churning roller 65, here, are rotated in a second rotation direction (clockwise direction indicated by arrow B in FIG. 2) opposite to the first rotation direction A. Also, the photosensitive drum 21, here, is rotated in the second rotation direction B.

In the developer tank 61, a thickness regulation member 87 (carrier chain forming regulation member) that regulates the transport amount of developer is provided on the upstream side in the developer transport direction (here the first rotation direction A) of the development sleeve 85 from a development area P where the electrostatic latent image on the photosensitive drum 21 is developed. Here, the thickness regulation member 87 has a plate-like shape. A partition plate 89 is provided to the rear of the thickness regulation member 87.

The partition plate 89 is disposed such that one end of the partition plate 89 is positioned above the development sleeve 85, and the other end is positioned above the churning roller 65.

In the development apparatus 24 provided with this configuration, due to the transport roller 63 being rotated in the second rotation direction B, toner that has been resupplied from the middle hopper 73 is mixed with developer, and the mixed developer is moved to the side of the churning roller 65. The churning roller 65 is rotated in the second rotation direction B and churns the developer, and due to this churning, the magnetic carrier and the toner in the developer are frictionally charged, thus conferring a electric charge on the magnetic carrier and the toner. The paddle roller 67, due to being rotated in the first rotation direction A, transports the developer from the churning roller 65 towards the developer bearing member 69.

Figure 3:
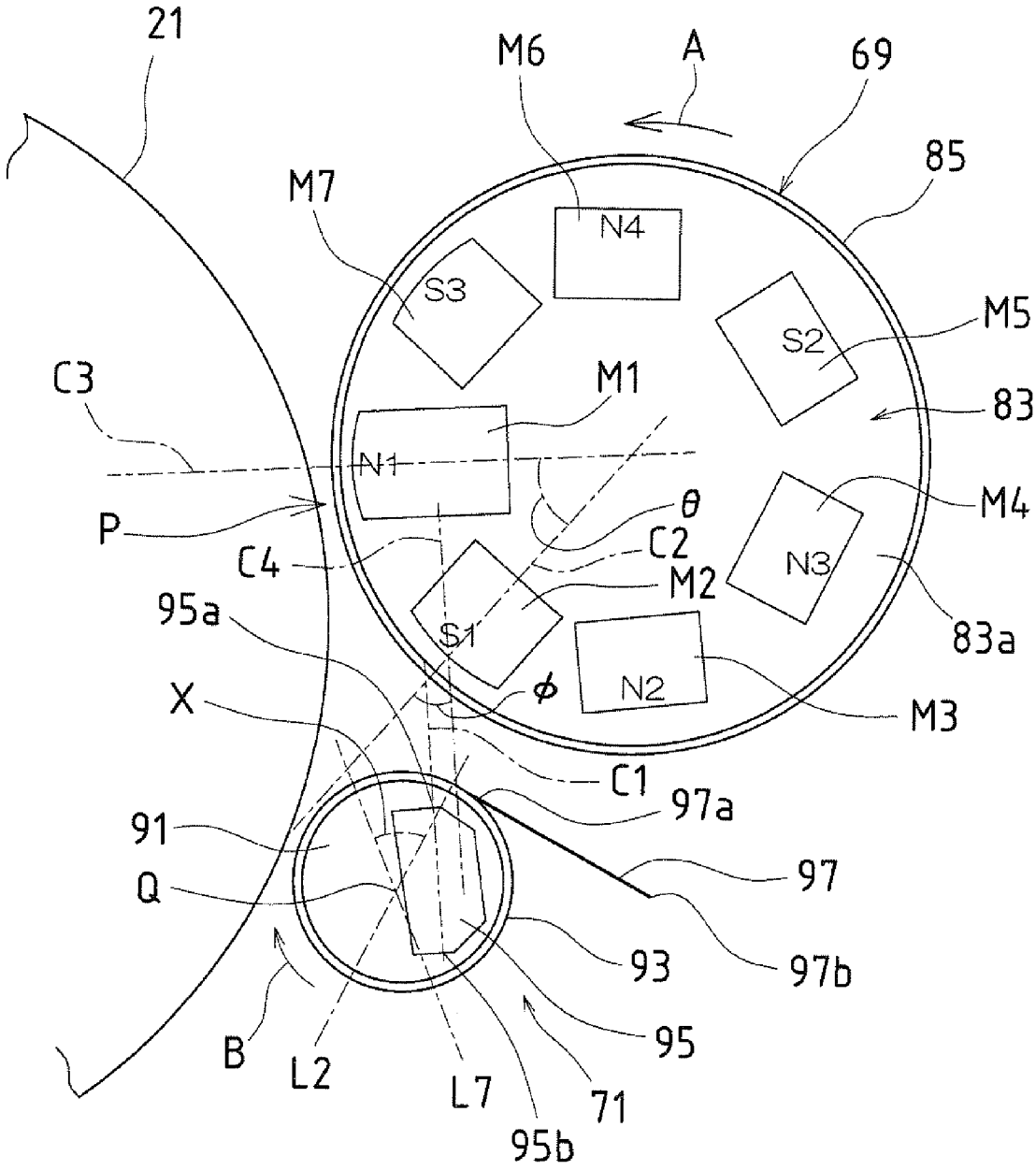
FIG. 3 is a schematic cross-sectional view that shows an enlargement of a developer bearing member portion shown in FIG. 2.

FIG. 3 is a schematic cross-sectional view that shows an enlargement of the developer bearing member 69 portion shown in FIG. 2. As shown in FIG. 3, the developer bearing member 69 has a magnetized portion 83 for forming a main pole N1 (here an N pole) that faces the development area P and for forming at least an interpole S1 (here an S pole) with a polarity that differs from the main pole N1 in the magnetic field on the downstream side in the developer transport direction (i.e., the rotation direction of the development sleeve 85) A of the main pole N1, and the development sleeve 85 provided on the outer circumference of the magnetized portion 83 so as to be rotatable relative to the magnetized portion 83.

The development sleeve 85 is a hollow body that carries developer stored in the developer tank 61 on the outer circumferential face, and transports that developer to the development area P. Inside the development sleeve 85, a main pole magnet M1 is provided, and at least a first interpole magnet M2 is provided.

The main pole magnet M1 forms the main pole N1 that faces the development area P, and the first interpole magnet M2 forms the interpole S1 provided adjacent on the downstream side in the developer transport direction A to the main pole N1. In detail, the first interpole magnet M2 is disposed such that an imaginary line C2 that joins both magnetic poles (S1, N1') is positioned at a position offset from an imaginary line C3 that joins both magnetic poles of the main pole magnet M1 by θ degrees (for example, 30 to 50°, here about 45°) to the downstream side in the developer transport direction A. The interpole S1, as described above, has a polarity opposite to that of the main pole N1.

The developer bearing member 69, here, is a developer roller, in which the development sleeve 85 has a cylindrical shape. The magnetized portion (below, referred to as a multipolar-magnetized magnet) 83 is disposed in a fixed manner, and supports the development sleeve 85 such that relative rotation is possible. The development sleeve 85 is formed with a non-magnetic body (for example, such as an aluminum alloy or stainless steel), and due to driving power being transmitted via a drive transmission means from an unshown drive source, the development sleeve 85 is rotationally driven in the first rotation direction A. Here, the diameter of the development sleeve 85 is about 30 mm.

The multipolar-magnetized magnet 83 has a columnar magnet holder 83*a*. At the outer circumferential portion of the magnet holder 83*a*, a plurality (here, seven) of grooves are formed at intervals in the circumferential direction, the grooves extending in the axial direction and open to the outside in the radial direction. In these grooves, bar-like permanent magnets M1 to M7 that extend in the axial direction are inlaid and made a single body with the magnet holder 83*a*, thus configuring the multipolar-magnetized magnet 83.

At least one magnet other than the main pole magnet M1 is an interpole magnet for forming an interpole. Here, six first to sixth interpole magnets M2 to M7 are disposed in this order in the developer transport direction A. In the outer circumferential portion of the multipolar-magnetized magnet 83, in addition to the main pole N1, interpoles (here, an S-pole, N-pole, N-pole, S-pole, N-pole, and S-pole) S1, N2, N3, S2, N4, and S3 of the first to sixth interpole magnets M2 to M7 are formed in this order in the developer transport direction A.

In the development apparatus 24 provided with this configuration, developer is carried by the magnetic force of the magnets M1 to M7 on the development sleeve 85 that relatively rotates around the multipolar-magnetized magnet 83, and due to rotation of the development sleeve 85, developer carried on the development sleeve 85 is transported to the development area P in a state with the transport amount regulated by the thickness regulation member 87.

The development apparatus 24 is further provided with a carrier recovery means 71. In the carrier recovery means 71, a pushing/bending magnetic pole 95*a* with the same polarity (here an S-pole) as the interpole S1 is formed so as to push/bend the magnetic force lines of the interpole S1 of the interpole magnet M2 in the developer bearing member 69 towards the inside of the developer tank 61.

Figure 5A:
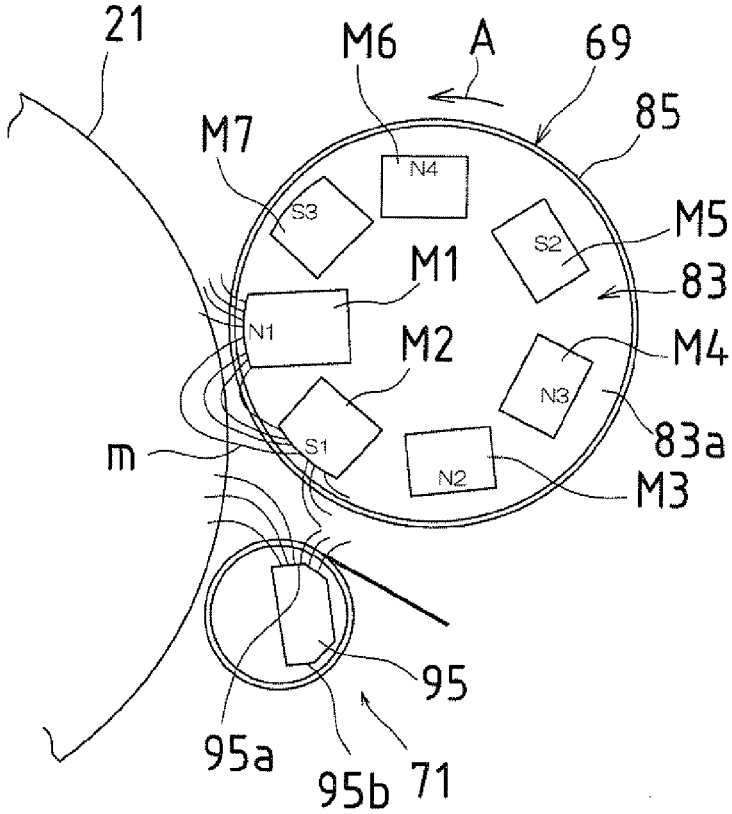
FIG. 5 is a pattern diagram for illustrating the state of interpole magnetic force lines in interpole magnets, with FIG. 5A showing the state of interpole magnetic force lines when a carrier recovery means is provided, and FIG. 5B showing the state of interpole magnetic force lines when a carrier recovery means is not provided.
Figure 5B:
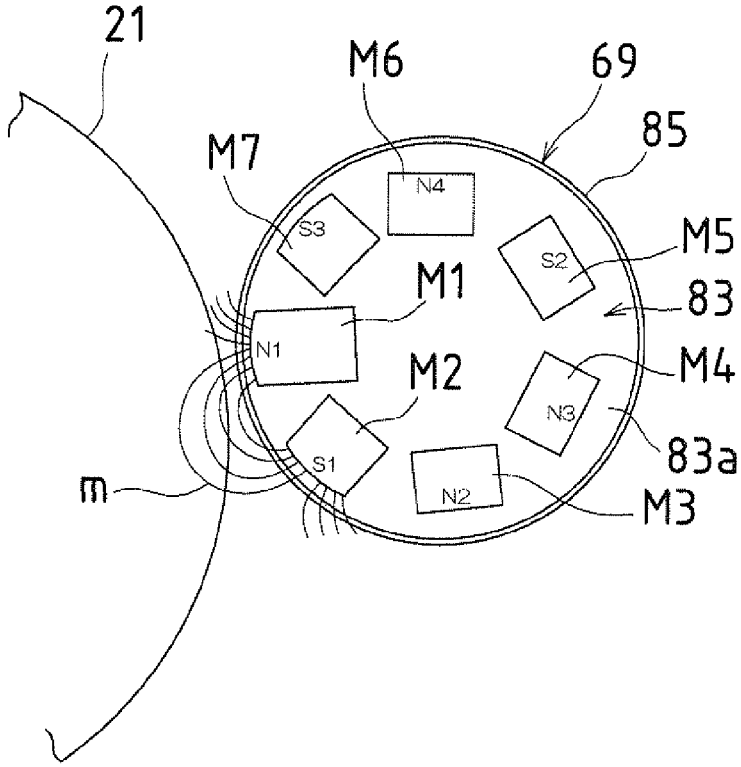

FIG. 5 (FIGS. 5A and 5B) shows pattern diagrams for illustrating the state of magnetic force lines m of the interpole S1 in the interpole magnet M2, with FIG. 5A showing the state of the magnetic force lines m of the interpole S1 when the carrier recovery means 71 is provided, and FIG. 5B showing the state of the magnetic force lines m of the interpole S1 when the carrier recovery means 71 is not provided.

The magnetic force lines m of the interpole S1 are in the state shown in FIG. 5B when the carrier recovery means 71 is not provided, and when the carrier recovery means 71 is provided, as shown in FIG. 5A, the magnetic force lines m of the interpole S1 are pushed/bent to the inside of the developer tank 61.

In the present embodiment, the carrier recovery means 71 is provided with a pushing/bending magnet 95 disposed near the downstream side in the developer transport direction A of the developer bearing member 69 from the development area P.

The pushing/bending magnet 95 is a permanent magnet, in which one magnetic pole 95*a* is a pushing/bending magnetic pole and is disposed at a position closer to the interpole S1 than the other magnetic pole 95*b*.

Figure 4:
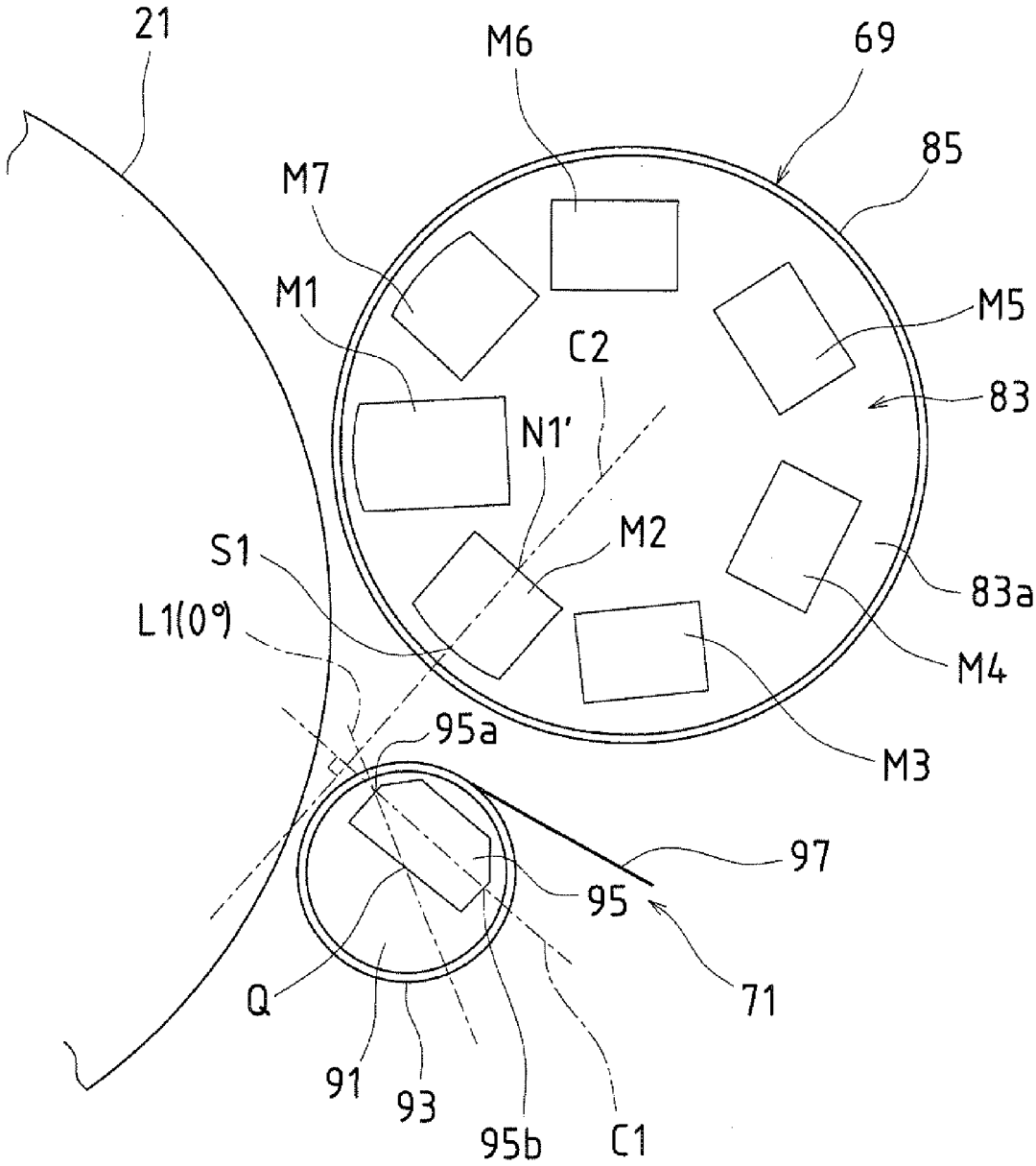
FIG. 4 is a schematic cross-sectional view for illustrating the arrangement of pushing/bending magnets shown in FIG. 3.

FIG. 4 is a schematic cross-sectional view for illustrating the arrangement of the pushing/bending magnet 95 shown in FIG. 3.

The pushing/bending magnet 95 shown in FIG. 3 is disposed such that, taking as a reference a state in which a first imaginary line C1 that joins both magnetic poles 95*a* and 95*b*, and a second imaginary line C2 that joins both magnetic poles S1 and N1' of the interpole magnet M2, are orthogonal as shown in FIG. 4, the first imaginary line C1 tilts in the direction that the one magnetic pole 95*a* serving as the pushing/bending magnetic pole approaches the side of the interpole S1.

The pushing/bending magnet 95 can preferably be disposed such that, taking as a reference a state in which the first imaginary line C1 and the second imaginary line C2 are orthogonal, the first imaginary line C1 tilts at an angle of 35 to 45° in the direction that the pushing/bending magnet pole 95*a* approaches the side of the interpole S1.

Also note that the pushing/bending magnetic pole 95*a* preferably is disposed on the downstream side in the developer transport direction A taking the second imaginary line C2 as a reference, and on the upstream side in the developer transport direction A taking as a reference a third imaginary line C4 obtained by rotating the second imaginary line C2 $\phi$ degrees (for example, 30 to 50°) in the developer transport direction A, centered on the interpole S1.

The pushing/bending magnet 95, here, is a bar-shaped (more specifically, approximately rectangular in cross-section) magnet that extends in the axial direction of the development sleeve 85.

In the development apparatus 24 described above, when development is performed, while the development sleeve 85 of the developer bearing member 69 is rotated in the direction of arrow A, developer is attracted to and carried on the outer circumferential face of the development sleeve 85 by the magnetic force of the multipolar-magnetized magnet 83, and thus a magnetic brush is formed.

With rotation of the development sleeve 85, the thickness of the developer on the outer circumferential face of the development sleeve 85 is regulated by the thickness regulation member 87 provided in the developer tank 61. Here, developer that has been separated from the developer bearing member 69 by the thickness regulation member 87 follows the bottom face of the partition plate 89 and is again returned to the churning roller 65 side.

At this time, toner in the developer layer on the outer circumferential face of the development sleeve 85 is frictionally charged by churning of the churning roller 65. Here, reverse development is adopted as the development system of the development apparatus 24, and toner is frictionally charged to the same polarity as the surface potential of the photosensitive drum 21.

The developer layer on the outer circumferential face of the development sleeve 85 that has been regulated by the thickness regulation member 87 is transported to the development area P where the magnetic brush has been formed by the main pole N1 between the development sleeve 85 and the photosensitive drum 21. Toner in the developer layer that has reached the development area P is electrostatically drawn and attracted to the electrostatic latent image on the surface of the photosensitive drum 21 by the development bias voltage, and thus the electrostatic latent image is made into a toner image.

When the development sleeve 85 rotates further, the magnetic carrier is peeled away along with the toner from the outer circumferential face of the development sleeve 85 in the repulsive magnetic field area formed by the magnetic poles N2 and N3 of the second and third interpole magnets M3 and M4 disposed adjacent to each other in the development sleeve 85. Thus the magnetic carrier and the toner that has been peeled away from the surface of the development sleeve 85 is returned to the developer tank 61. In this manner, while development is being performed, carrying of developer on and release of developer from the outer circumferential face of the developer sleeve 85 is repeatedly performed.

At the time of this development (during development and/or after development), carrier may scatter from the magnetic brush in the developer bearing member 69.

With respect to this point, with the development apparatus 24, using the carrier recovery means 71, it is possible to form the pushing/bending magnetic pole 95*a* with the same polarity as the interpole S1, such that magnetic force lines of the interpole S1 of the first interpole magnet M2 in the developer bearing member are pushed/bent towards the inside of the developer tank 61. It is possible to attract carrier that scatters in the magnetic brush in the developer bearing member 69 during development to the developer tank 61 side. Accordingly, carrier that scatters in the magnetic brush and attempts to move to the photosensitive drum 21, or carrier that scatters in the magnetic brush and attempts to drop inside the image forming apparatus 100, can be effectively recovered into the developer tank 61, and thus it is possible to effectively prevent the movement of carrier to the photosensitive drum 21 or the dropping of carrier inside the image forming apparatus 100. Thus it is possible to eliminate problems due to carrier scattering such as a deterioration in image quality.

Also, in the pushing/bending magnet 95, taking as a reference a state in which the first imaginary line C1 and the second imaginary line C2 are orthogonal (see FIG. 4), when the pushing/bending magnet pole 95*a* is disposed such that the first imaginary line C1 tilts at an angle of 35 to 45° in the direction approaching the side of the interpole S1, it is possible to effectively attract carrier that scatters in the magnetic brush in the developer bearing member 69 during development to the developer tank 61 side. Thus it is possible to more effectively recover carrier that scatters in the magnetic brush into the developer tank 61.

In the present embodiment, the carrier recovery means 71 is further provided with a carrier recovery sleeve 93 and a scraper 97.

The carrier recovery sleeve 93 has a cylindrical shape and is capable of rotating relative to the pushing/bending magnet 95. The pushing/bending magnet 95 is provided inside the carrier recovery sleeve 93. The scraper 97 is disposed in contact with the outer circumferential face of the carrier recovery sleeve 93, so as to scrape away carrier that is attracted to the outer circumferential face of the carrier recovery sleeve 93, and guide that carrier into the developer tank 61.

With the carrier recovery means 71 provided with this configuration, even if carrier that scatters in the magnetic brush in the developer bearing member 69 moves to the photosensitive drum 21, carrier that has moved to the photosensitive drum 21 can be attracted to the outer circumferential face of the carrier recovery sleeve 93 by the magnetic force of the pushing/bending magnet 95 inside the carrier recovery sleeve 93. Also, even if carrier scatters and drops from the magnetic brush in the developer bearing member 69, that carrier can be attracted to the outer circumferential face of the carrier recovery sleeve 93. Also, by rotating the carrier recovery sleeve 93 (here, rotation in the second rotation direction B), it is possible to scrape away carrier that has been attracted to the outer circumferential face of the carrier recovery sleeve 93 that is rotated with the scraper 97 and guide that carrier inside the developer tank 61. Note that even if the magnetic pole 95*a* of the pushing/bending magnet 95 does not face the surface of the photosensitive drum 21, it is possible to recover carrier from the photosensitive drum 21.

In this manner, it is possible to recover and reuse carrier, so it is possible to improve the longevity of developer.

Also, in the present embodiment, a single pushing/bending magnet 95 is provided in the carrier recovery sleeve 93. By providing a single pushing/bending magnet 95 in this manner, it is possible to increase the area of the magnetic pole face of the pushing/bending magnetic pole 95*a*, and to that extent it is possible to increase the strength of the magnetic pole 95*a*. Thus, it is possible improve the effect of pushing/bending the magnetic force lines of the interpole S1 to the inside of the developer tank 61, and so it is possible to improve the efficiency of recovering carrier that scatters in the magnetic brush into the developer tank 61. Further, carrier in the magnetic brush that has moved to the photosensitive drum 21 without being recovered into the developer tank 61, and carrier that has scattered and dropped from the magnetic brush, can to that extent be more easily attracted to the outer circumferential face of the carrier recovery sleeve 93 with the pushing/bending magnet 95.

Also, in the present embodiment, the pushing/bending magnet 95 is provided at a position such that, in a state in which the first imaginary line C1 and the second imaginary line C2 are orthogonal, the first imaginary line C1 is offset to the interpole S1 side from a center of rotation Q of the carrier recovery sleeve 93. Also, the pushing/bending magnet 95 is disposed such that the first imaginary line C1 tilts from the above state with the center of rotation Q of the carrier recovery sleeve 93 as a fulcrum. By adopting such a configuration, it is possible to place the pushing/bending magnet 95 as close as possible to the interpole S1, and thus it is possible to further improve the pushing/bending effect.

Further described, the carrier recovery sleeve 93 is supported so as to be capable of rotating relative to a cylindrical main body 91, around the main body 91. Also, the main body 91 supports the pushing/bending magnet 95 in a fixed manner. Thus, the carrier recovery sleeve 93 rotates relative to the main body 91 in a state in which the pushing/bending magnet 95 has been fixed to the main body 91. Here, the carrier recovery sleeve 93 is idly rotated in the second rotation direction B by rotational driving of the development sleeve 85.

Specifically, the carrier recovery sleeve 93 is formed with a non-magnetic body (such as an aluminum alloy or stainless steel). Carrier is attracted to the outer circumferential face of the carrier recovery sleeve 93 by the magnetic force of the pushing/bending magnet 95 provided inside, and in a state supported by the main body 91, the carrier recovery sleeve 93 is rotated in the second rotation direction B. Also, here, an interval distance (gap) between the developer bearing member 69 and the carrier recovery sleeve 93 is about 3 mm. Here, the diameter of the carrier recovery sleeve 93 is about 12 mm.

Also, the scraper 97 is plate-shaped, and a tip portion 97*a* thereof makes contact with the carrier recovery sleeve 93.

The scraper 97 is disposed approximately parallel to the tangent line of the carrier recovery sleeve 93, and is disposed such that the tip portion 97*a* contacts the carrier recovery sleeve 93 and a base end portion 97*b* points toward the inside of the developer tank 61. Thus, carrier that has been attracted to the outer circumferential face of the rotated carrier recovery sleeve 93 by the magnetic force of the pushing/bending magnet 95 can be scraped away, and recovered into the developer tank 61.

The scraper 97 can be formed from a material that is more flexible than the carrier recovery sleeve 93, for example, a resin film of PET (polyethylene terephthalate) resin or the like. The scraper 97, here, due to being formed not from a metal such as an aluminum alloy or stainless steel, but from a resin film of PET resin or the like, does not grind down the carrier recovery sleeve 93, and so greater longevity of the carrier recovery sleeve 93 is achieved.

It is preferable that the scraper 97 contacts the outer circumferential face of the carrier recovery sleeve 93 with a contact pressure of 1.96 to 6.86 kPa. By adopting such a configuration, the scraper 97 can scrape away carrier attracted onto the carrier recovery sleeve 93 and recover that carrier into the developer tank 61. Thus, that carrier can be effectively recovered into the developer tank 61 by the scraper 97. Carrier that has been recovered into the developer tank 61 is again mixed with toner by the paddle roller 67 or the like, transported to the developer bearing member 69, and reused.

(Evaluation Tests)

Next, from a state in which the first imaginary line C1 of the pushing/bending magnet 95 in the carrier recovery means 71 and the second imaginary line C2 of the interpole magnet M2 in the developer bearing member 69 were orthogonal (see FIG. 4), the main body 91 was rotated using the center of the main body 91 as the center of rotation Q, and the carrier recovery effect was investigated. Testing conditions were as follows.

As developer, a two-component developer was used that included a polyester resin black toner with an average particle diameter by volume of 6.7 μm, and a resin coated carrier with an average particle diameter by weight of 40 μm or 50 μm (magnetic particle: copper-magnesium ferrite, coating agent: n-butyl methacrylate and silicone resin). The toner concentration of this developer was 6 wt %.

Also, the magnetic flux density of the interpole S1 (here an S-pole) of the interpole magnet M2 was 0.09 T (Tesla)(900 G(Gauss)), the magnetic flux density of the magnetic pole 95*a* (here an S-pole) of the pushing/bending magnet 95 was 0.03 T (Tesla)(300 G(Gauss)), and the carrier attracting electric potential was set to 300 V.

Figure 6:
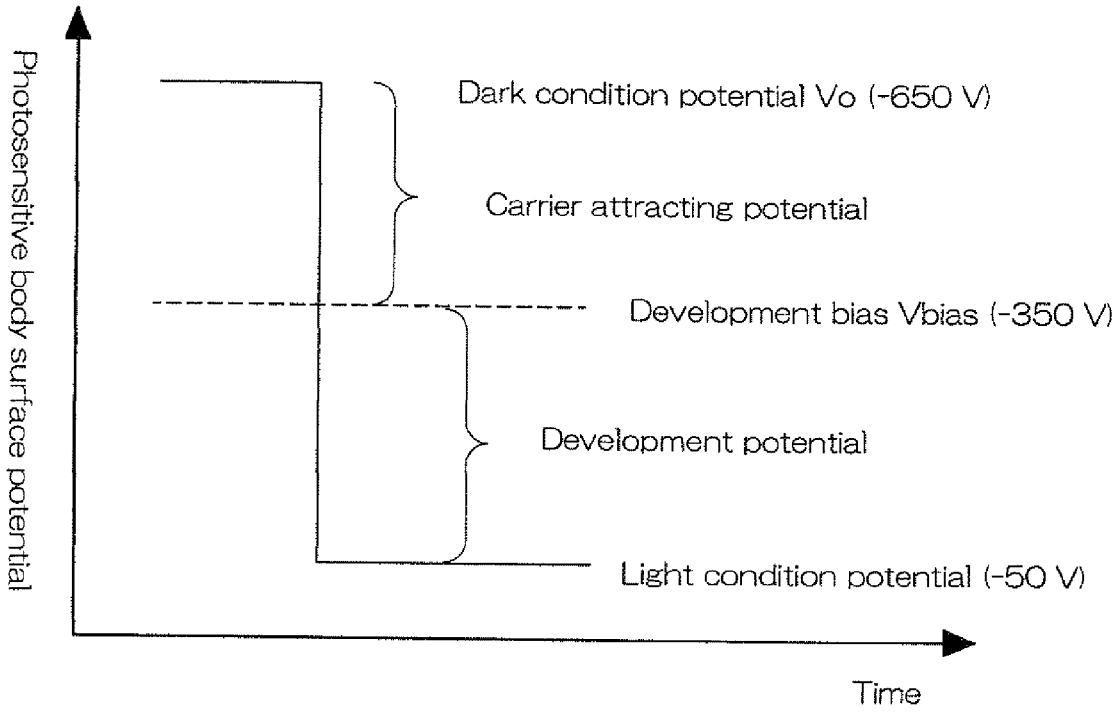
FIG. 6 is for illustrating a carrier attracting electric potential.

The carrier attracting electric potential prescribed here, as shown in FIG. 6, is a potential difference obtained by subtracting a dark condition potential (V0) of the photosensitive body prior to light exposure from the development bias voltage (Vbias).

The amount of developer (transport amount) on the development sleeve 85 was 0.1 to 0.12 g/cm$^2$, the gap between the thickness regulation member 87 and the developer bearing member 69 was about 0.9 mm, and thereby development conditions were adopted such that it was possible to insure a toner affixing amount on the photosensitive drum 21 of 0.4 to 0.5 g/cm$^2$ when performing solid image processing.

Evaluation of the carrier recovery effect was performed by peeling away carrier affixed on the photosensitive drum 21 with adhesive tape and counting the number of carrier particles. That is, when the number of carrier particles peeled away with the adhesive tape is small, the amount of carrier affixed on the photosensitive drum 21 is small, and so it is possible to determine that the carrier recovery means 71 is effectively recovering scattered carrier. Thus, assuming an area of adhesive tape of 76.8 cm$^2$, up to 30 carrier particles was considered good (○), 31 to 50 carrier particles was considered fair (Δ), and 51 particles or more was considered poor (x).

The testing results are shown in Table 1 below.

TABLE 1

| Test | Position of S-pole 95a of magnet 95 (angle° from position where first imaginary line of magnet 95 and second imaginary line of magnet M2 are orthogonal) | Number of carrier particles (particles/76.8 cm$^2$) | Evaluation |
|---|---|---|---|
| 1 | −10 | 100 | X |
| 2 | 0 | 25 | ○ |
| 3 | +15 | 25 | ○ |
| 4 | +30 | 15 | ○ |
| 5 | +35 | 10 | ○ |
| 6 | +39 | 5 | ○ |
| 7 | +45 | 10 | ○ |
| 8 | +50 | 50 | Δ |

The angle in Table 1 indicates a value when, in a state in which the first imaginary line C1 and the second imaginary line C2 shown in FIG. 4 are orthogonal, a reference imaginary line L1 that joins the pushing/bending magnetic pole 95*a* of the pushing/bending magnet 95 and the center of rotation Q is used as a reference (0°).

With the reference imaginary line L1 used as a reference (0°), a case in which the main body 91 is rotated counter clockwise, i.e., is rotated to the opposite side as the rotation direction B of the carrier recovery sleeve 93 (direction that the magnetic pole 95*a* separates from the interpole S1), is considered as minus (−). Also, with the reference imaginary line L1 used as a reference (0°), a case in which the main body 91 is rotated clockwise, i.e., is rotated to the side of the rotation direction B of the carrier recovery sleeve 93 (direction that the magnetic pole 95*a* approaches the interpole S1), is considered as plus (+).

As shown in Table 1, it was ascertained that carrier recovery is effectively performed by rotating the main body 91 around the center of the main body 91 in the clockwise direction, so that the reference imaginary line L1 in the position where the first imaginary line C1 and the second imaginary line C2 shown in FIG. 4 are orthogonal becomes the position of an imaginary line L2 after rotation of the main body 91 shown in FIG. 3.

That is, it was ascertained that, from a state in which the first imaginary line C1 of the pushing/bending magnet 95 and the second imaginary line C2 of the interpole magnet M2 are orthogonal, when the pushing/bending magnet 95 has been rotated around the center of rotation Q such that the first imaginary line C1 tilts in the direction that the magnetic pole 95*a* approaches the interpole S1 side of the interpole magnet M2 (here, rotational direction B side of the carrier recovery sleeve 93), the carrier recovery ratio is good.

In particular, it was ascertained that the carrier recovery ratio is good in a position that the pushing/bending magnet 95 has been rotated, from a position where the first imaginary line C1 and the second imaginary line C2 are orthogonal, in the direction that the magnetic pole 95*a* approaches the interpole S1 side, around the center of rotation Q 35 to 45°, and more preferably 39°.

That is, where X is the intersection angle of the reference imaginary line L1 at the position where the first imaginary line C1 and the second imaginary line C2 are orthogonal, and the imaginary line L2 after rotation of the main body 91, by disposing the pushing/bending magnet 95 such that the intersection angle is about 35 to 45°, it is possible to more effectively recover carrier.

More specifically, as shown in FIG. 4, in a state in which the first imaginary line C1 and the second imaginary line C2 are orthogonal, there is a maximum peak of the combined magnetic force strength of the pushing/bending magnetic pole 95*a* (here, an S-pole) of the pushing/bending magnet 95 and the interpole S1 (here, an S-pole) of the interpole magnet M2. Said another way, in a state in which the first imaginary line C1 and the second imaginary line C2 are orthogonal, in magnetic force measurement in a plane perpendicular to the rotational axis of the developer bearing member 69, there is a maximum peak of the combined magnetic force strength of the interpole S1 of the developer bearing member 69 and the pushing/bending magnetic pole 95*a* of the carrier recovery means 71.

Accordingly, from a position where there is a maximum peak of the combined magnetic force strength of the pushing/bending magnetic pole 95*a* and the interpole S1, by disposing the pushing/bending magnet 95 such that the first imaginary line C1 tilts in the direction that the pushing/bending magnetic pole 95*a* approaches the interpole S1 side (here, rotational direction B side of the carrier recovery sleeve 93), the magnetic force lines m of the interpole S1 are pushed/bent to the inside of the developer tank 61 (see FIG. 5A). Note that the combined peak position can be confirmed by a measurement apparatus or by simulation.

Also, under the same conditions as the above testing, the number of carrier particles on the photosensitive drum 21 were also counted for a case in which the carrier recovery means 71 was not provided, and those results are shown in Table 2 below.

TABLE 2

| Test | Carrier average particle diameter by weight (μm) | Carrier recovery means | Number of carrier particles (particles/76.8 $cm^2$) |
|---|---|---|---|
| 9 | 50 | none | 1000 |
| 10 | 40 | none | 1000 |

Next, the carrier recovery effect of the scraper 97 of the carrier recovery means 71 according to the force with which the scraper 97 is pressed against the carrier recovery sleeve 93 was also tested.

In this testing, the pushing/bending magnetic pole 95*a* of the pushing/bending magnet 95 was moved to a position rotated to the inside of the developer tank 61 39° from the combined peak position. Also, the carrier average particle diameter by weight was 40 μm.

Same as in the testing described above, the evaluation was performed by peeling away carrier on the carrier recovery sleeve 93 with adhesive tape and counting the number of particles.

As a result, it was ascertained that when the tip portion 97*a* of the scraper 97 contacts the carrier recovery sleeve 93 so as to be approximately parallel to the tangent line of the carrier recovery sleeve 93, the carrier recovery effect is excellent when the contact pressure is at least 1.96 kPa and not more than 6.86 kPa (at least 20 g/$cm^2$ and not more than 70 g/$cm^2$). When the pressure was less than 1.96 kPa, the pressure was too weak and so carrier entered under the scraper and carrier recovery could not be effectively performed, and when the pressure was greater than 6.86 kPa, the present pressure was too strong and in this case as well it was not possible to effectively perform carrier recovery.

When measuring the pressure, a configuration was adopted in which the man body 91 could be moved up and down, the weight of the development apparatus 24 in a state with the scraper 97 placed on the carrier recovery sleeve 93 was read with a spring balance, and this value was set to a reference value (0 g). Afterward, the main body 91 was moved to the scraper 97 side to press the scraper 97 against the carrier recovery sleeve 93, the weight at this pressure-adjusted time was read with a spring balance, the weight at this time was divided by the contact area of the scraper 97 with the carrier recovery sleeve 93, and this value was converted to kPa.

The development apparatus and image forming apparatus are not limited to the present embodiments, and can be appropriately modified. For example, in the present embodiments, the pushing/bending magnetic pole 95*a* of the pushing/bending magnet 95 is an S-pole and the interpole S1 of the interpole magnet M2 is an S-pole, but these magnetic poles 95*a* and S1 may also both be N-poles. However, in this case the main pole of the main pole magnet M1 becomes an S-pole.

Note that in the present embodiment, a configuration was adopted in which a monochrome image is formed, but a configuration can also be adopted in which a color image is formed.

Also, in the present embodiment, the carrier recovery means 71 was disposed in the development apparatus 24, but by providing the carrier recovery means 71 in the image forming apparatus 100, it is possible to dispose the carrier recovery means 71 outside of the development apparatus 24.

The present technology may be embodied in various other forms without departing from the spirit or essential characteristics thereof. The embodiments disclosed in this application are to be considered in all respects as illustrative and not limiting. The scope of the technology is indicated by the appended claims rather than by the foregoing description, and all modifications or changes that come within the meaning and range of equivalency of the claims are intended to be embraced therein.

What is claimed is:

1. A development apparatus that, in an image forming apparatus, develops an electrostatic latent image formed on an image bearing carrier by forming a magnetic brush using a two-component developer that includes a toner and a carrier, the development apparatus comprising:

a developer tank that stores the developer;

a developer bearing member comprising:

a development sleeve that carries the developer stored in the developer tank on the outer circumferential face and transports the developer to a development area where the electrostatic latent image on the image bearing carrier is developed, a main pole magnet in which a main pole is formed that faces the development area, and an interpole magnet in which an interpole is formed, the interpole magnet being adjacent to the main pole magnet on the downstream side of the main pole magnet in a developer transport direction; and a carrier recovery means disposed on the downstream side of the development area in the developer transport direction, the carrier recovery means comprising a pushing/bending magnet having a pushing/bending magnetic pole of the same polarity as the interpole disposed at a position nearer to the interpole than the other magnetic pole of the pushing/bending magnet such that magnetic force lines of the interpole in the developer bearing member are pushed/bent to the inside of the developer tank, and wherein taking as a reference a state in which a first imaginary line that joins both of the magnetic poles of the pushing/bending magnet and a second imaginary line that joins both magnetic poles of the interpole magnet are orthogonal, the pushing/bending magnet is disposed such that the first imaginary line tilts in a direction that results in the pushing/bending magnetic pole approaching the interpole side.

2. The development apparatus according to claim 1, wherein taking as a reference a state in which the first imaginary line and the second imaginary line are orthogonal, the pushing/bending magnet is disposed such that the first imaginary line tilts at an angle of 35 to 45° in the direction that results in the pushing/bending magnetic pole approaching the interpole side.

3. The development apparatus according to claim 1, wherein the carrier recovery means further comprises a cylindrical carrier recovery sleeve, inside of which is provided the pushing/bending magnet, and that is capable of rotating relative to the pushing/bending magnet, and a scraper that scrapes away carrier attracted to the outer circumferential face of the carrier recovery sleeve, and is disposed in contact with the outer circumferential face of the carrier recovery sleeve so as to guide that carrier into the developer tank.

4. The development apparatus according to claim 3, wherein the pushing/bending magnet provided inside the carrier recovery sleeve is a single magnet.

5. The development apparatus according to claim 4, wherein in a state in which the first imaginary line and the second imaginary line are orthogonal, the pushing/bending magnet is disposed at a position such that the first imaginary line is offset to the interpole side from the center of rotation of the carrier recovery sleeve, and from this state so as to be tilted around the center of rotation.

6. The development apparatus according to claim 3, wherein the scraper is formed from a resin film.

7. The development apparatus according to claim 6, wherein the scraper contacts the outer circumferential face of the carrier recovery sleeve with a pressure of 1.96 to 6.86 kPa.

8. An image forming apparatus, comprising the development apparatus according to claim 1.

* * * * *